United States Patent [19]

Skrobisch

[11] 4,327,357

[45] Apr. 27, 1982

[54] MAGNETIC INDICATOR ASSEMBLY

[75] Inventor: Alfred Skrobisch, Commack, N.Y.

[73] Assignee: The Staver Company, Inc., Bay Shore, N.Y.

[21] Appl. No.: 144,763

[22] Filed: Apr. 28, 1980

[51] Int. Cl.[3] ..... G08B 5/24

[52] U.S. Cl. ..... 340/373; 340/815.08, 340/815.02, 340/764

[58] Field of Search ..... 340/373, 378, 764

[56] References Cited

U.S. PATENT DOCUMENTS 3,581,301 5/1971 Basserdorf ..... 340/764

*Primary Examiner*—Harold I. Pitts

*Attorney, Agent, or Firm*—Edward H. Loveman

[57] ABSTRACT

A magnetic indicator assembly has a casing containing a stator comprising a reversibly magnetizable core carrying a wire coil. A rotor is angularly turnable around said casing through an angle of approximately 120° to expose either one of two flags carried by the rotor on angularly disposed walls of a nonmagnetic member. The rotor carries a block supporting two coplanar, aligned bar magnets oppositely polarized. Either one of the magnets is attracted to the core depending on the polarity of the magnetic circuit as determined by the energization of the wire coil.

10 Claims, 12 Drawing Figures

MAGNETIC INDICATOR ASSEMBLY

BACKGROUND OF THE INVENTION

This invention relates to the art of magnetic indicator assemblies, and more particularly concerns a magnetic indicator assembly having an improved rotor structure and an improved magnetic core structure.

One difficulty experienced with prior magnetic indicators is interference with operation of the indicators by adjacent indicators due to leakage of magnetic flux from one indicator to the other. The rotors of the prior indicators generally rotate approximately 180° in order to retract the indicator flag out of sight. This has been necessary because the permanent magnet customarily used in the rotor is parallel and close or actually in the plane of the rotor face. Without making the outer casing unacceptably large, the pole pieces protruding from the coil, could not be faced toward each other to reduce the spreading of magnetic flux when the coil is energized. Since the larger sizes of indicators require greater flux strength at the pole, this problem becomes severe as size increases. The present invention is directed at overcoming the above mentioned disadvantage of prior art magnetic indicators.

SUMMARY OF THE INVENTION

According to the invention, the magnetic indicator is provided with a stator including a magnetic core made of a permanent magnet material of relatively low coercive force of U-shape, with the ends thereof inturned toward one another to form a rectangular core with a gap in one leg. If desired the core may be comprised of two rectangular C-shaped core pieces disposed around a coil form. Each piece of the core has a longer flat base and a shorter flat top. The two core pieces are disposed in coplanar disposition with the longer base ends substantially touching within the coil form which has an energizing coil wound thereon. The inturned spaced shorter tops of the core pieces serve as opposite magnetic poles of the magnetic circuit and serve to confine the magnetic flux of the magnetic circuit and prevent interference with adjacent indicator assemblies. The conservation of the flux provides a stronger magnetic circuit for rotating the rotor of the assembly. By forming the core as two separate pole pieces, it is possible to prefabricate the magnetic wire winding of a form and then insert the longer base ends of the pole pieces into the coil form. This simplifies manufacture, however, it is possible if desired to use a rectangular shaped core with a gap in one leg and wire wound around the core.

The indicator rotor also has an improved structure and may be formed from a single piece of nonmagnetic metal such as aluminum bent to form two flat walls defining an acute angle thereinbetween or if desired, the walls may be independantly formed at an acute angle to one another. The outer sides of these walls carry differently colored indicia or flags. Each of the flags of the rotor is provided with a bar magnet which coacts with the shorter tops of the pole pieces of the core. For reversing the polarity of the pole pieces the core may carry a conventional single winding or one which is center tapped. The rotor is rotatably mounted on arms of a casing containing the core. When the core is magnetized by a pulse of current in one direction or with one polarity, the rotor turns in one direction to expose one colored flag. When the core is oppositely magnetized, the rotor turns in the opposite direction to expose the other colored flag. The length of each bar magnet is slightly longer than the space between the short tops of the pole pieces so as to bridge the gap and complete the magnetic circuit.

BRIEF DESCRIPTION OF THE DRAWING

These and other objects and many of the attendant advantages of this invention will be readily appreciated as the same becomes better understood by reference to the following detailed description when considered in connection with the accompanying drawings in which.

DESCRIPTION OF THE PREFERRED EMBODIMENT

Figure 10:
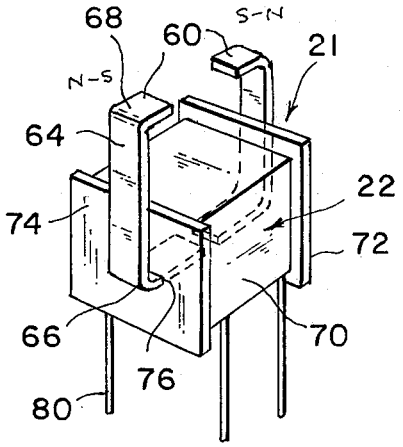
FIG. 10 is a perspective view of the magnetic core of the indicator assembly.
Figure 1:
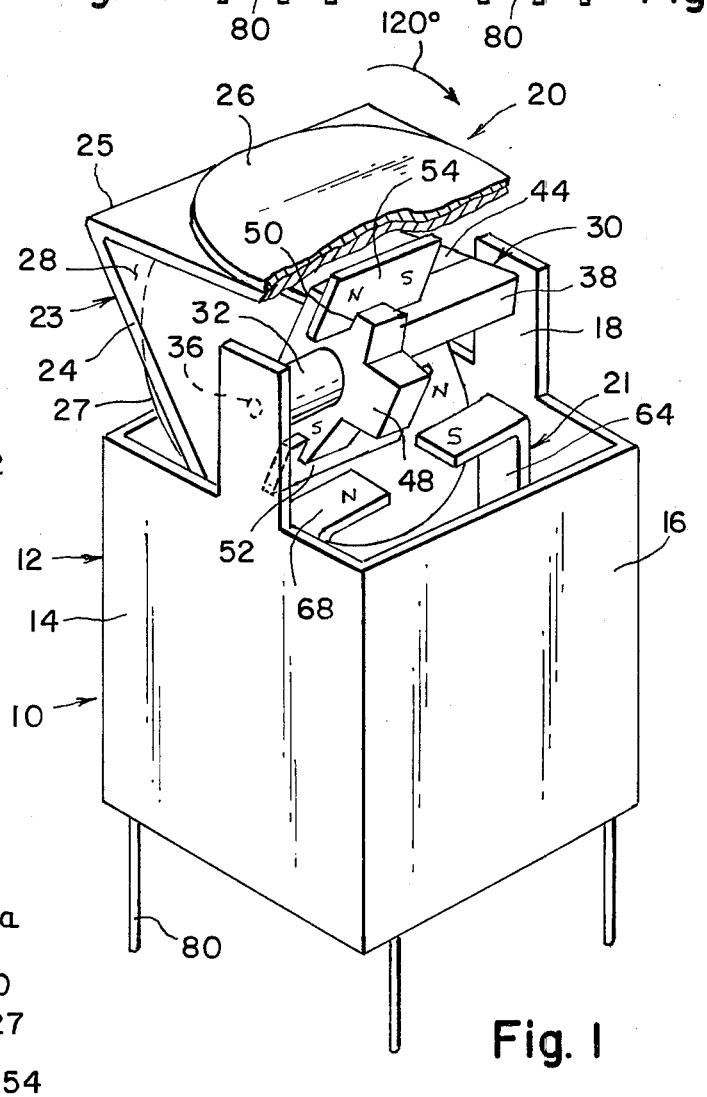
FIG. 1 is a perspective view of a magnetic indicator assembly embodying the invention.
Figure 5:
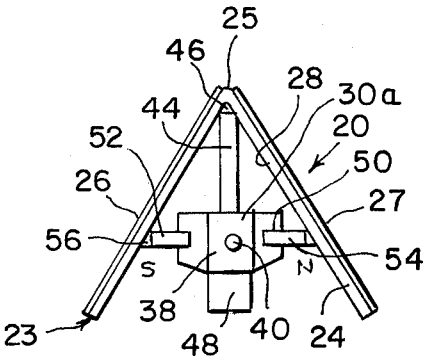
FIG. 5 is a further enlarged end view of the rotor per se.
Figure 6:
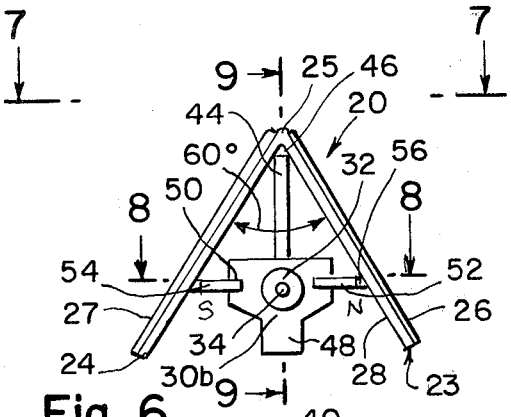
FIG. 6 is an end view similar to FIG. 5 showing the other end of the rotor.
Figure 9:
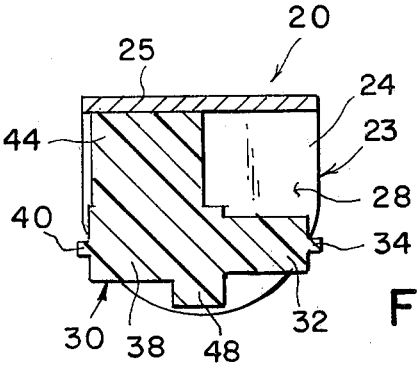
FIG. 8 and FIG. 9 are horizontal and vertical sectional views taken along lines 8—8 and 9—9 respectively of FIG. 6.
Figure 8:
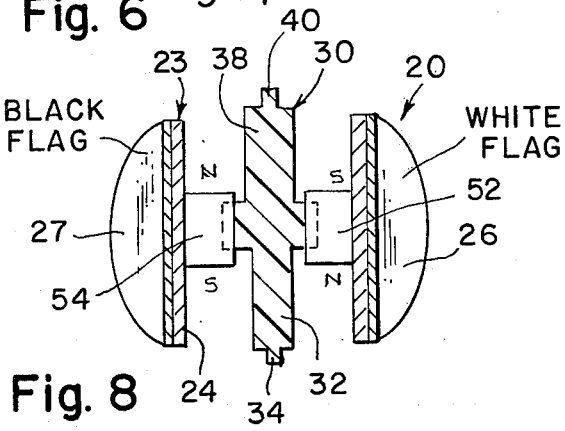
Figure 4:
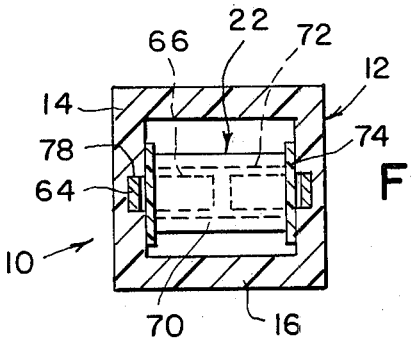
FIG. 4 is an enlarged cross sectional view taken along line 4—4 of FIG. 2.
Figure 7:
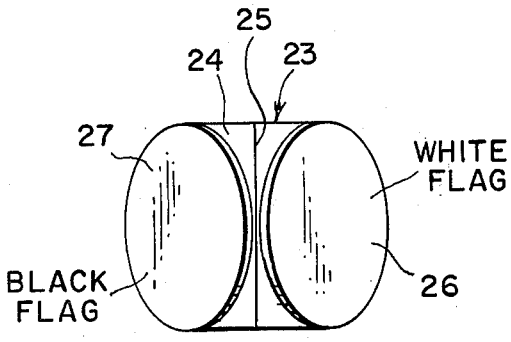
FIG. 7 is a top plan view taken along line 7—7 of FIG. 6.

Referring now to the drawings wherein like reference characters designate like or corresponding parts there throughout, there is illustrated in FIGS. 1–4, a magnetic indicator assembly generally designated as reference numeral 10 embodying the invention. The assembly 10 comprises a rectangular hollow casing 12 having side walls 14 and end walls 16. The casing 12 is open at the top and bottom. The side walls 14 have flat opposing extensions 18 defining arms which support an angularly rotatable rotor 20 embodying features of the invention and shown in detail in FIGS. 5–9. Inside the hollow casing 12 is a stator 21 embodying features of the invention and shown in detail in FIGS. 10 and 11.

The rotor 20 shown in FIGS. 1–3 and 5–9 comprises a thin nonmagnetic metal sheet bent across a central line to define a V-shaped member 23 having two walls 24 disposed at an angle of 60° to each other and meeting at an apex 25. The outer sides of the walls 24 carry indicia such as differently colored circular flags 26, 27. The flags may be colored white and black respectively. The inner side 28 of member 23 is colored black. Inside the member 23 is secured a nonmagnetic block 30. The block has a laterally extending cylindrical shaft 32 at one side terminating in a trunnion 40 rotatably journaled in a recess in the other arm 18 of the casing 12. A plate 44 integral with the bar 38 and the block 30 extends up to the apex 25 and is secured there by cement 46. The block 30 may have an extension 48 which serves as a counterweight for the angularly turning rotor 20.

The block 30 is formed with two end slots 50 in which are inserted and secured the respective narrow side of an elongated permanent bar magnet 52, 54. The magnets 52, 54 are positioned in the block 30 so that the N pole of magnet 52 and the S pole of the magnet 54 are outermost and on the one side 30*a* of the block 30 and the S pole of the magnet 52 and the N pole of the magnet 54 are outermost and on the opposite side 30*b* of the block 30. The magnets 52 and 54 are secured by cement 56 to inner sides of the rotor walls 24; see FIGS. 5 and 6.

Figure 11:
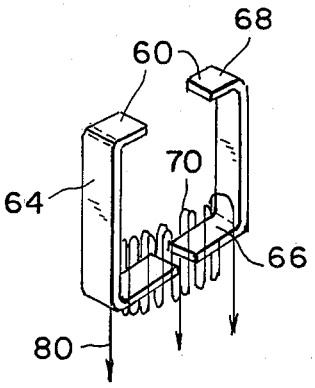
FIG. 11 is a perspective view, partially schematic in form of the pole pieces and winding of the magnetic core.
Figure 12:
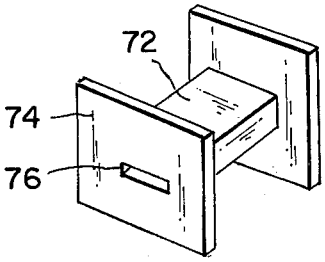
FIG. 12 is a perspective view of a coil form.

The stator 21 shown in FIGS. 1, 4, 10 and 11 comprises a magnetic core 22 having two identical rectangular C-shaped pole pieces 60 each having parallel flat side walls 64, longer flat bases 66 and shorter flat tops 68. The bases 66 are disposed in coplanar alignment with each other as best shown in FIG. 11. Adjacent ends of the bases 66 touch one another or are closely spaced from each other. A rectangular coil of insulated wire 70 surrounds bases 66. This coil or winding 70 may be preformed on a nonmagnetic rectangular form 72 and have end flanges 74 and a central flat axial passage 76 in which the bases 66 are inserted at opposite ends of the winding 70. The form 72 is best shown in FIG. 12. The side walls 64 of the pole pieces 60 are snugly fitted in a slot 78 formed in opposed sides of the side wall 14 of the casing 12; see FIG. 4, so that the core 22 extends across the casing 12 between walls 14. Although not shown, the slot 78 terminates at a point above the bottom of the casing 12.

The tops 68 of the pole pieces 60 serve as poles of the magnetic core 22. They are oppositely polarized magnetically when the winding is energized. Ends of the poles 68 are spaced apart. The gap between the poles 68 is bridged by either one of the bar magnets 52 and 54 to complete the magnetic circuit.

Figure 2:
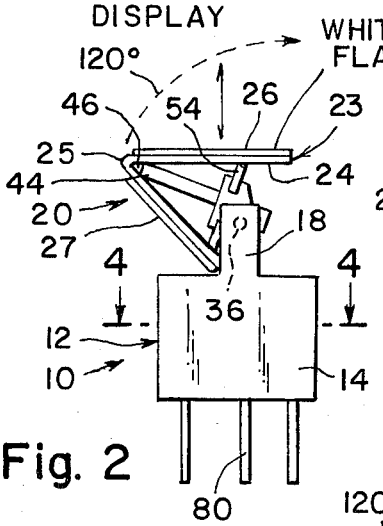
FIG. 2 is a reduced side view showing the rotor in one position displaying one colored flag.
Figure 3:
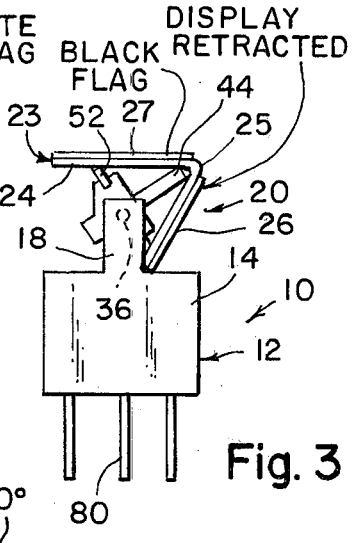
FIG. 3 is a side view similar to FIG. 2 showing the rotor rotated 120° from the position of FIG. 2 displaying the other colored flag.

In operation of the assembly 10, when the winding 70 is energized from external circuitry via terminal leads 80, the poles will be magnetized strongly in one magnetic direction as N and S poles respectively or the polarity can be reversed and the poles will have S and N polarity. If for example, the left and center terminals 80 of FIG. 11 are energized, the left pole is N and the right pole is S as viewed in FIG. 1 and will repulse the N and S poles respectively, of the bar magnet 54 and attract the S and N poles respectively of bar magnet 52 whereby the rotor 20 will rotate counterclockwise to dispose the white flag 26 horizontally as shown in FIG. 2. If the magnetic polarity of the pole pieces is reversed, by energizing the right and center terminals 80 of FIG. 11, the polarity of poles 68 will reverse and the left pole will become S and right pole N (FIG. 1), thereby the repelling magnet 52, and attracting magnet 54 so that the rotor 20 will rotate clockwise to the position shown in FIG. 3, with the black flag 27 exposed and the white flag 26 retracted.

The inwardly turned poles 68 are arranged so that they concentrate their magnetic flux to affect the bar magnets, and little flux strays outside the casing 12. In this way the magnetic flux avoids interference with adjacent indicator assemblies. Similarly the poles are self-protecting because the concentrated magnetic circuit is closed and is not influenced by outside stray magnetic flux. Although the rotor has been illustrated to comprise a single shaped member 23 having two walls 24 with an apex angle of 60° thereinbetween, the apex angle may be any acute angle between 45° and 90°. Moreover, if desired, the walls 24 may be separated from each other rather than bent from one member so long as the apex angle lies in the range of 45° and 90°. The entire assembly can be made in small sizes by economical mass production methods. It is fool-proof in operation and completely reliable.

It should be understood that the foregoing relates to only a preferred embodiment, of the invention which has been by way of example only and that it is intended to cover all changes and modifications of the example of the invention herein chosen for the purposes of the disclosure, which do not constitute departures from the spirit and scope of the invention.

What is claimed is:

1. A magnetic indicator assembly comprising:

a support;

a rotor angularly rotatable on said support, said rotor comprising:

two indicating flags angularly positioned from each other by an acute angle thereinbetween; and a permanent bar magnet associated with each of said flags;

a stator in said support, comprising a reversible magnetizable magnetic core arranged for attracting one of said magnets when said core is magnetized with a particular polarity and wherein said core is comprised of four rectilinear legs which form a rectangle with a gap in one of said legs, said one leg juxtaposed to said rotor and a winding on said core, and wherein each of said magnets is longer than said gap in said one leg.

2. A magnetic indicator assembly as defined in claim 1 wherein said core is comprised of a pair of C-shaped pole pieces having base ends in coplanar alignment and a wire winding having an axial passage therethrough, said base ends being inserted in said passage.

3. A magnetic indicator assembly as defined in claim 2 wherein said pole pieces have free flat top ends disposed in coplanar alignment and spaced apart to define a gap thereinbetween, said top ends constituting oppositely polarized poles for a magnetic circuit maintained in said core when said winding is electrically energized.

4. A magnetic indicator assembly as defined in claim 2 wherein said support is a hollow rectangular nonmagnetic casing, said pole pieces having side walls snugly fitted in said casing.

5. A magnetic indicator assembly as defined in claim 2 wherein said winding is wound on a coil form which receives said flat base ends of said pole pieces.

6. A magnetic indicator as defined in claim 1 wherein said acute angle lies between 45° and 90°.

7. A magnetic indicator assembly as defined in claim 1, wherein said rotor has a member formed with a pair of integral angularly spaced walls carrying said flags, and wherein said casing has arms rotatably supporting said rotor so that said rotor need turn only 180° minus the angle between said angularly spaced walls to expose one flag and conceal the other flag and vice versa.

8. A magnetic indicator assembly as defined in claim 1 wherein said rotor further comprises a nonmagnetic block carrying said magnets in coplanar alignment.

9. A magnetic indicator assembly as defined in claim 8, wherein said block is provided with a counterweight to facilitate turning of said rotor to expose either one of the flags and to conceal the other flag.

10. A magnetic indicator assembly as defined in claim 1, wherein said flags are separated from each other by 60°.

* * * * *